United States Patent [19]

Waitzinger

[11] Patent Number: 4,585,355

[45] Date of Patent: Apr. 29, 1986

[54] CONCRETE MIXER TRUCK

[75] Inventor: Franz Waitzinger, Nersingen, Fed. Rep. of Germany

[73] Assignee: Gerhard Hudelmaier, Ulm/Donau, Fed. Rep. of Germany

[21] Appl. No.: 685,024

[22] Filed: Dec. 21, 1984

[30] Foreign Application Priority Data

Dec. 28, 1983 [DE] Fed. Rep. of Germany ..... 3347310

[51] Int. Cl.[4] ..... B28C 5/24

[52] U.S. Cl. ..... 366/55; 366/56; 366/61; 366/64; 366/108; 366/124

[58] Field of Search ..... 366/55, 108, 113, 114, 366/117, 118, 119, 124, 125, 61, 60, 40, 219, 241, 56, 64

[56] References Cited

U.S. PATENT DOCUMENTS 2,968,915 1/1961 Felstel ..... 366/61
3,608,866 9/1971 Karpacheva ..... 366/124
3,754,737 8/1973 O'Dea ..... 366/61
3,773,304 11/1973 Hodgson ..... 366/61
4,478,514 10/1984 Hudelmaier ..... 366/40

*Primary Examiner*—Robert W. Jenkins
*Attorney, Agent, or Firm*—James E. Nilles

[57] ABSTRACT

The invention relates to a concrete mixer truck having a rotatably driven mixer drum, particularly a drum provided with interior mixing elements, and a hydraulic system as a drive source for the mixing process.

It is intended to enhance the effect of the mixing process by transmitting vibration energy to the mixture materials. To this effect, a vibration generator is included in the hydraulic system in such a manner that pressure pulses generated in the flow of the hydraulic fluid are superimposed on the mixing movement in the form of vibrations. This superposition effect may be achieved with respect to the rotation of the drum and/or with respect to the movements of a separate mixing tool.

3 Claims, 3 Drawing Figures

CONCRETE MIXER TRUCK

BACKGROUND OF THE INVENTION

The present invention relates to a concrete mixer truck having a drum wherein there are mixer elements that are moved to effect agitation of mixture in the drum.

It is known U.S. Pat. No. 4,478,514 to transmit vibration energy to the mixture material by means of a vibrator projecting into the interior of the mixer drum. Employed as a vibration generator is an independent vibration system energized by means of water. A vibrator body may thus be energized by admixture water discharged therefrom in a pulsating stream or by an eccentric member mounted therein and rotated by the water flowing therethrough. The generation of the desired vibrations is thus achieved by a more complicated structure. Moreover, the vibrator, which does not itself participate in the actual mixing process, but merely facilitates the mixing process by loosening the materials to be mixed by its vibrations, occupies valuable space adjacent the bottom of the drum interior, which space might otherwise accommodate an additional mixer element.

SUMMARY OF THE INVENTION

It is an object of the invention to improve a concrete mixer truck of the type described so as to further improve the mixing effect and to facilitate the generation of vibrations by simple means.

In accordance with the invention, this object is attained by the provisions described hereinafter, comprising, in general, a vibration generator connected in the hydraulic circuit that provides for energization of a hydraulic actuator for mixer elements of the mixer.

The arrangement according to the invention of a vibration generator in the hydraulic fluid circuit results in the vibration effects being multiplied in a simple manner: As the drum as a whole is subjected to the generated vibrations, the vibration pulses are transmitted to the mixture materials from all sides, i.e. from the entire interior surface of the drum and from the large surface areas of the helical vanes supported on the drum wall. This results in the interior friction of the mixture materials being reduced so as to intensify the mixing process. In addition, the vibrations adduce beneficial effects with regard to emptying and cleaning the drum, which is likewise accompanied by the mixing movements. Concrete residues adhering to the wall of the drum and/or to the helical vanes are loosened by the vibrations, resulting in the drum being more completely discharged, whereby the subsequent cleaning is substantially facilitated. In addition to the reduction of the turnaround time, itself quite important in the operation of concrete mixer trucks, the above aspects result in a considerably reduced water consumtion. The water for cleaning the drum has usually to be carried along by the truck, resulting in an increased loading weight, the reduction of which has obviously favourable effects. The purification of the cleaning water in a concrete supply installation constitutes a considerable cost factor, the reduction of which by the employ of a concrete mixer truck according to the invention obviously results in considerable economical benefits.

An embodiment of the invention wherein the mixer elements comprise blades secured to the drum and actuated in consequence of rotation of the drum by the hudraulic actuator achieves the above explained advantages with a minimum of technical effort, as the drive source for rotating the drum is always there. The mixing effect is considerably increased, as the drum as a whole participates in transmitting the vibration energy to the mixture materials. This arrangement does not interfere with the mounting of an additional mixing tool projecting into the interior of the drum or with the rotational or reciprocating movement of such mixing tool. The location of the drum's bottom, forming a passage for the shaft of the mixing tool, may be advantageously designed so as to transmit the vibrations of the drum also to the mixing tool.

The invention permits a rotatable or reciprocating mixing tool to be additionally operable as a vibrator, irrespective of whether or not the drum is also capable of being vibrated.

Embodiments of concrete mixer trucks according to the invention are described hereinafter with reference to the accompanying drawings, in which all parts of the mixer itself and the truck, which are not essential with respect to the present invention have been left out for the sake of clarity.

DESCRIPTION OF THE PREFERRED EMBODIMENTS

Figure 1:
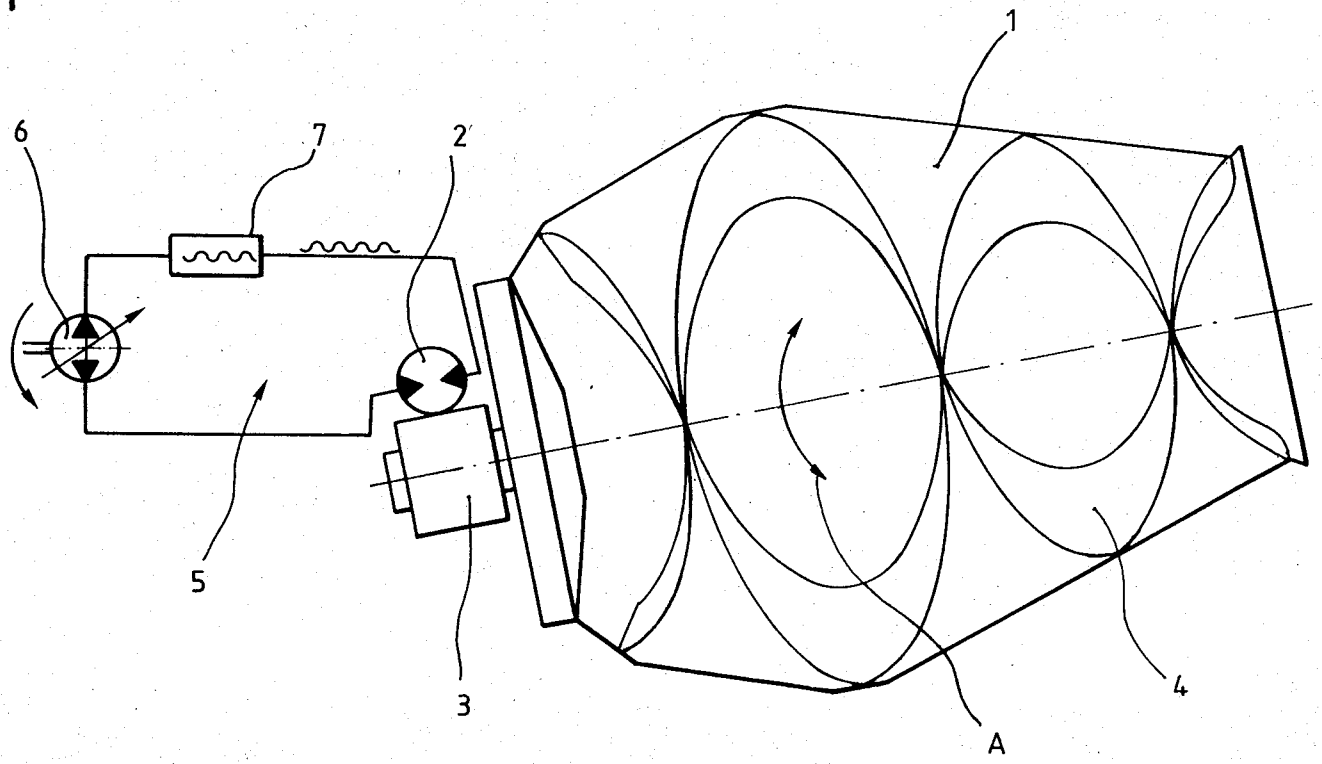
FIG. 1 shows a diagrammatic view of a mixer drum with its drive means.

The drum 1 shown in FIG. 1 is adapted to be rotated by a hydraulic motor 2 connected to a reduction gear 3. Helical mixing elements 4 are secured to the interior wall surface of drum 1. The drum may be rotated in opposite directions as indicated by a double arrow A.

Hydraulic motor 2 belongs to a closed hydraulic circuit generally designated 5 and containing a hydraulic pump 6. A vibration generator 7 is inserted in circuit 5 in such a manner that pressure pulses generated thereby in the flow of the hydraulic fluid are transmitted to drum 1, resulting in oscillating vibrations being induced in the drum during rotation thereof, with helical mixing elements 4 participating in the vibration. The large surface area of the interior wall surface of the drum and of the helical mixing elements effectively transmits the vibration energy to the mixture materials. This results in the interior friction of the mixture materials being reduced in various areas, whereby a thorough mixing process is promoted. On emptying and/or cleaning of the drum, adhering residual matter is effectively loosened.

Figure 2:
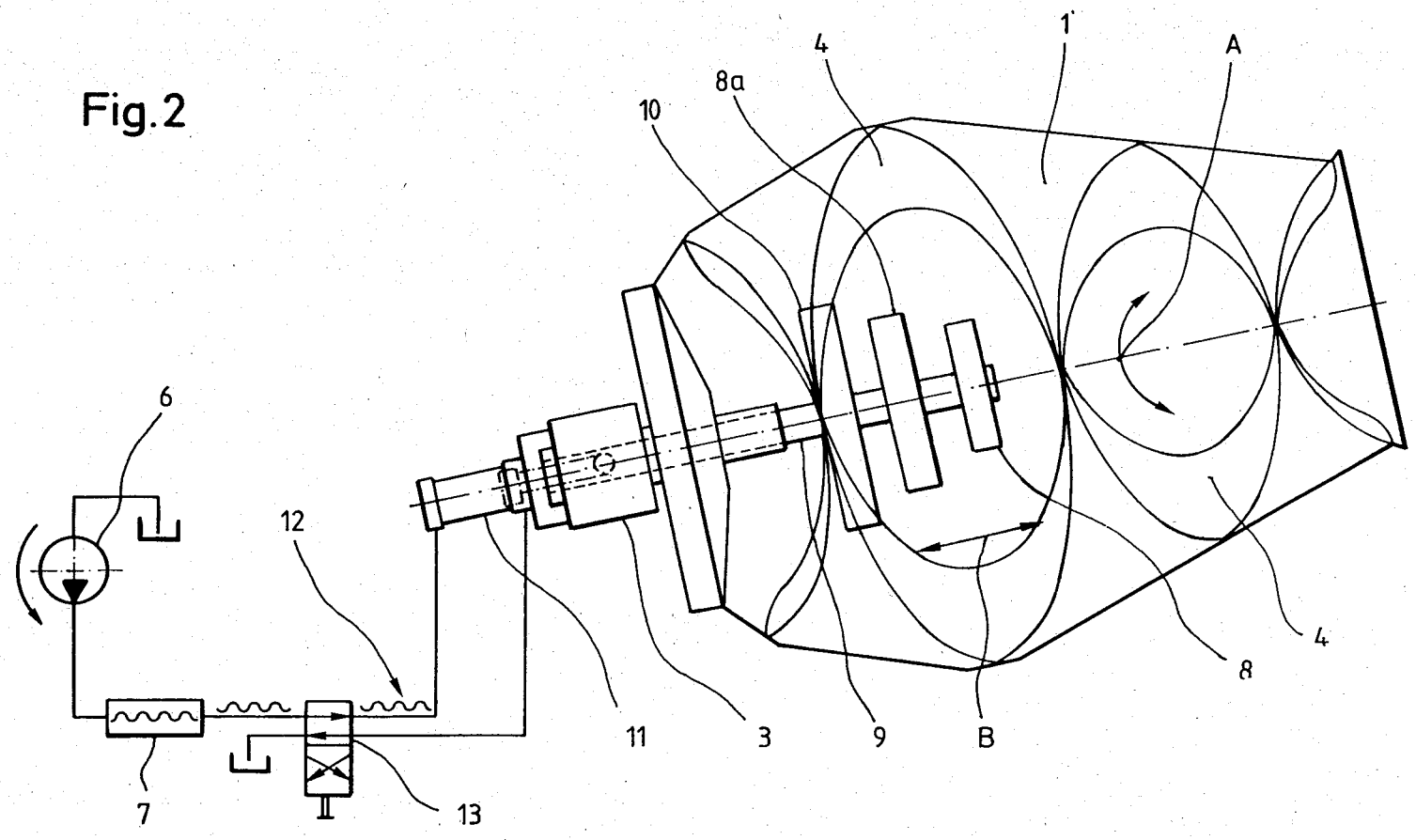
FIG. 2 shows a mixer drum with an additional mixing tool and drive means therefor.

FIG. 2 shows a drum 1' having helical mixing elements 4 of the type shown in FIG. 1. Drum 1' is adapted to be rotated in opposite directions indicated by double arrow A through a reduction gear 3. The drum is rotatably driven without vibrations being induced therein. This may be accomplished by a conventional hydraulic drive source or by mechanical transmission from the truck engine.

A mixing tool 8 projects from the bottom of drum 1' into the drum's interior. Tool 8 comprises a shaft 9 extending through the drum's bottom and carrying arms 10. A hydraulic cylinder 11 is operable to move shaft 9 back and forth in its axial direction as indicated by a double arrow B. Cylinder 11 is connected to a hydraulic system generally indicated at 12 and including a hydraulic pump 6, a vibration generator 7, and a reversing valve 13.

The pressure pulses in the flow of the hydraulic fluid generated by vibration generator 7 are transmitted to hydraulic cylinder 11 to result in oscillating vibrations of mixing tool 8 superimposed on the back and forth movements thereof. The friction-reducing effect on the mixture material acts particularly adjacent the bottom of the drum, whereat the greatest amount of the mixture material is contained during the mixing process.

Figure 3:
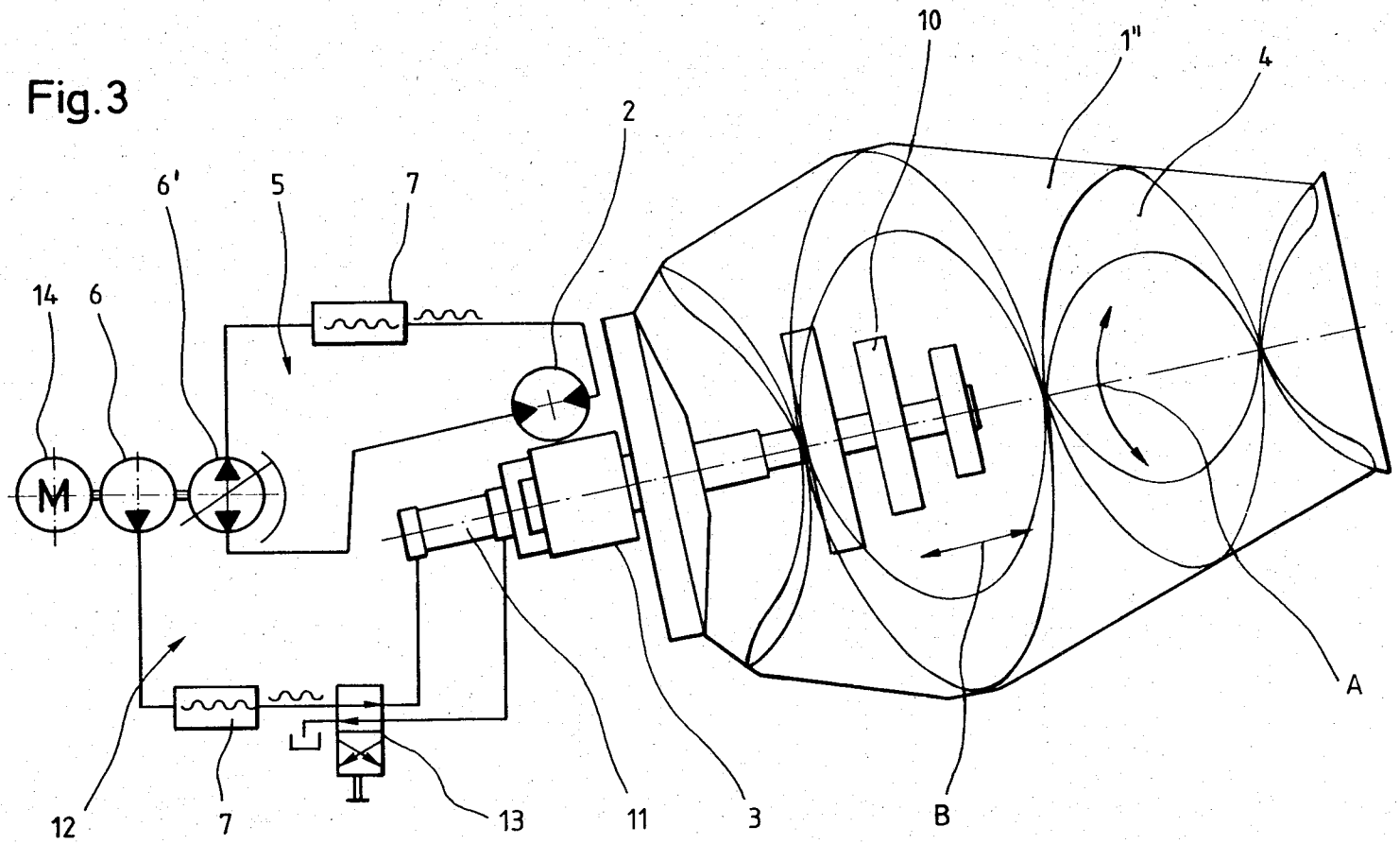
FIG. 3 shows a mixer drum with a mixing tool and drive means for the drum and for the mixing tool.

FIG. 3 shows a mixer drum 1'' provided with helical mixing elements 4 on its interior wall surface and containing, as in the case of mixer drum 1' in FIG. 2, a mixing tool 8 mounted for back and forth movement as indicated by double arrow B. A common hydraulic pressure source has a first branch leading to pump 6 of hydraulic system 12 associated to mixing tool 8. The components of hydraulic system 12 correspond to those of the system shown in FIG. 2. Hydraulic system 12 is operable to induce the back and forth mixing movements in tool 8 together with the superimposed vibrations. A second branch of the common hydraulic pressure source leads to hydraulic circuit 5 including a second hydraulic pump 6', a separate vibration generator 7 and a hydraulic motor 2 connected to reduction gear 3 for rotating drum 1'' and at the same time for inducing vibrations in the drum. The concrete mixer truck of FIG. 3 thus permits the mixing process to be carried out either solely by rotating and vibrating the drum, solely by actuating and vibrating the mixing tool, or by combined actuation of the drum and the mixing tool. The combined mixing movements and vibrations ensure a particularly good result of the mixing process, particularly in the case of difficult to mix materials, such as in a dry mixing process.

I claim:

1. A concrete mixer truck having a drum wherein there are mixer elements that are moved to effect agitation of mixture in said drum, hydraulic actuating means drivingly connected with said mixer elements for moving the same, a pump, and hydraulic circuit means for delivering hydraulic fluid under pressure from said pump to said actuating means to energize the latter, said mixer truck being characterized by:

a vibration generator connected in said hydraulic circuit means, whereby hydraulic fluid delivered to said actuating means is pulsed so that the actuating means operates with a vibration that it imposes upon said mixer elements.

2. The concrete mixer truck of claim 1 wherein said drum is rotatable and said mixer elements are secured to the drum to be moved by rotation thereof, and wherein said hydraulic actuating means drives the drum for rotation so that the vibration which said actuating means imposes upon said mixer elements is transmitted to them through the drum.

3. The concrete mixer truck of claim 1 wherein said drum is substantially closed at a bottom end thereof, wherein said mixer elements are carried by a mixing tool projecting substantially coaxially into the drum through said bottom end thereof, and wherein said actuating means actuates said mixing tool.

* * * * *